US006079166A

United States Patent [19]

Mason et al.

[11] Patent Number: 6,079,166

[45] Date of Patent: Jun. 27, 2000

[54] ROOF CLOSURE VENT SYSTEM

[75] Inventors: Dwayne L. Mason, Houston, Tex.; Charles F. Garrison, 130 W. North Hill, Spring, Tex. 77388

[73] Assignee: Charles F. Garrison, Spring, Tex.

[21] Appl. No.: 08/857,706

[22] Filed: May 16, 1997

Related U.S. Application Data

[63] Continuation-in-part of application No. 08/777,929, Dec. 23, 1996.

[51] Int. Cl.[7] ..... E04B 7/00

[52] U.S. Cl. ..... 52/198; 52/199; 52/302.1; 454/365

[58] Field of Search ..... 52/198, 199, 57, 52/302.1, 95; 454/260, 365; 55/525, 527, 516, 519

[56] References Cited

U.S. PATENT DOCUMENTS

| | | | |
|---|---|---|---|
| Re. 27,943 | 3/1974 | Smith | 98/42 |
| 2,789,493 | 4/1957 | Riggle | 98/88 |
| 2,885,942 | 5/1959 | Hirst | 98/37 |
| 3,051,071 | 8/1962 | Leigh | 98/37 |
| 3,481,263 | 12/1969 | Belden | 98/42 |
| 3,683,785 | 8/1972 | Grange | 98/35 |
| 4,126,973 | 11/1978 | Luckey | 52/91 |
| 4,325,290 | 4/1982 | Wolfert | 98/42 A |
| 4,545,291 | 10/1985 | Kutsch et al. | 98/42.21 |
| 4,622,887 | 11/1986 | Peterson | 98/66.1 |
| 4,635,419 | 1/1987 | Forrest | 52/303 |
| 4,643,080 | 2/1987 | Trostle et al. | 98/42.21 |
| 4,676,145 | 6/1987 | Allred | 98/29 |
| 4,676,147 | 6/1987 | Mankowski | 98/42.21 |
| 4,776,262 | 10/1988 | Curran | 98/37 |
| 4,843,953 | 7/1989 | Sells | 98/42.21 |
| 4,876,950 | 10/1989 | Rudeen | 98/42.21 |
| 4,907,499 | 3/1990 | James | 98/42.21 |
| 4,924,761 | 5/1990 | MacLeod et al. | 98/42.21 |
| 4,942,699 | 7/1990 | Spinelli | 52/57 |
| 5,092,225 | 3/1992 | Sells | 454/365 |
| 5,339,582 | 8/1994 | Sells | 52/198 |
| 5,352,154 | 10/1994 | Rotter et al. | 454/365 |
| 5,425,672 | 6/1995 | Rotter | 454/365 |
| 5,427,571 | 6/1995 | Sells | 454/365 |
| 5,473,847 | 12/1995 | Crookston | 52/302.1 |
| 5,603,657 | 2/1997 | Sells | 454/359 |

OTHER PUBLICATIONS

Metallic Products Corporation, Louvers–Ventilators–Trim-Roof Curbs–Specialty Items brochure entitled Roof Curbs.

Metallic Products Corporation brochure on Ridge Ventilator with dieformed side skirt.

Table of Capacities for Continuous Ventilators.

Metallic Products Corporation brochure entitled Low Profile Floating Ridge Vent . . . Ridgeline.

*Primary Examiner*—Creighton Smith

*Attorney, Agent, or Firm*—Dwayne L. Mason; Winstead Sechrest & Minick P.C.

[57] ABSTRACT

A roof ventilation system of the type for venting air from under a roof and preventing water, debris and pests from penetrating the ventilation system and entering the interior of the structure is provided. The roof closure vent system includes: a structure having a sloped metal roof having a ridge slot formed along substantially the length of a roof ridge permitting ventilation from the interior under said roof to the exterior; and a ridge closure vent positioned adjacent each longitudinal side of said ridge slot extending substantially along the length thereof fastened between said roof and a ridge panel, in place of the ridge closure vent or in combination therewith is a eave closure vent connected beneath said roof substantially along the length of an eave of said roof.

40 Claims, 3 Drawing Sheets

ROOF CLOSURE VENT SYSTEM

This is a continuation-in-part of application Ser. No.: 08/777,929, entitled Roof Closure Vent System, filed Dec. 23, 1996

GENERAL DESCRIPTION

The present invention relates to devices for roof ventilation and more particularly to devices for roof ventilation that include eave and/or ridge closure vents for providing ventilation of structures having metal roofs.

It has been a long known practice to ventilate structures having sloped roofs by creating a vent opening along the roof ridge. The vent opening is created during construction by sizing the uppermost row of sheeting panels to leave an open slot running along the ridge extending essentially the length of the roof. The slot permits air to vent from the structure by convection flow and by suction created by the differential pressure from wind blowing across the roof. Maximum air flow from under the roof would occur if the ridge slot were left uncovered, however, the need to keep water, dirt and pests out of the structure requires a covering over the slot. Commonly, in metal roof installations, a ridge panel or cap is connected to the top row of roof panels atop the ridge slot with a closure strip or mastic disposed between the ridge panel and the roof panels. This manner of covering the ridge slot prevents the desired ventilation from under the roof. It is also known for ventilators to be installed atop the ridge slot, however, these prior art ventilators require additional installation, man hours and increase the expense of constructing a metal roof.

In many structures having non-metal roofs soffit ventilators are frequently used in conjunction with the ridge vent to provide passive ventilation. The soffit vents allow fresh ambient air to flow into the structure to equalize the temperature and pressure with the outside. As stale hot air is withdrawn from the ridge slot vent by convection and/or differential pressure, it is replaced by fresh ambient air entering the structure through the soffit vents.

Commonly, in metal roof structures there is not a soffit to install vents. In metal roof installations the roof panels are connected to the eave strut with a closure strip disposed therebetween. This manner of installing the roof panels prevents passive ventilation to aid in ventilation through the roof ridge.

It would be a benefit, therefor, to have a metal roof ventilation system which permits ventilation along the ridge and/or passive ventilation along the eave line. It would be a further benefit to have a ridge closure vent and an eave closure vent which permits the roof panels and ridge panel to be securely attached to the structure while allowing ventilation from beneath the roof. It would be a still further benefit to have a ventilation system which has layered closure vents which prevent water, debris and pests from penetrating the closure vents. It would be a still further benefit, to have a metal roof ventilation system which does not require additional labor, equipment or accessories from the conventional metal roof installations.

It is thus an object of the invention to provide a roof closure vent system that has a ridge closure vent and/or an eave closure vent.

It is a further object of the invention to provide a roof closure vent system that has layered closure vents which provide ventilation without permitting the penetration of water, debris and pest therethrough.

It is a still further object of the invention to provide a roof closure vent system that permits ventilation without compromising the secure installation of the roof panels and the ridge panel.

It is a still further object of the invention to provide a roof closure vent system that does not require any additional labor, equipment or accessories from conventional metal roof installations.

Accordingly, a roof ventilation system of the type for venting air from under a roof and preventing water, debris and pests from penetrating the ventilation system and entering the interior of the structure is provided. The roof closure vent system includes: a structure having a sloped metal roof having a ridge slot formed along the length of a roof ridge permitting ventilation from the interior under said roof to the exterior; and a ridge closure vent positioned adjacent each longitudinal side of said ridge slot extending along the length thereof fastened between said roof and a ridge panel, in place of the ridge closure vent or in combination therewith is a eave closure vent connected beneath said roof substantially along the length of an eave of said roof. While the ridge closure vent and an eave closure vent is described, the present invention may be utilized on any metal roof installation along any available seam in place of a conventional closure to vent the structure.

In a preferred embodiment of the roof closure vent system, ridge closure vents are positioned adjacent each longitudinal side of the ridge slot or opening. The ridge closure vent includes a first closure member having perforations formed laterally therethrough for air/gas to pass, exiting the interior of the structure. The ridge closure vent also includes a longitudinal filter slot extending substantially along its length and is of sufficient depth such that the perforations and filter slot are in communication forming a gas flow path. Disposed within the filter slot is a filter, which deters and prevents the entry of water, debris and pests from entering the interior of the structure through the perforations. The ridge closure vent is constructed so that its profile matches the contour of the roof panels and ridge panel that it is connected between. Thus, it will be clear to one skilled in the art that the ridge closure vent of the present invention may be used in place of conventional closures for any panel geometry. The first closure member may also include weep holes along its bottom surface to allow water which may condense interior of the closure vent or in the mesh mat to drain therefrom.

The ridge closure vent may include additional closure members each having perforations formed laterally therethrough. The closure members may be inter-connected by bonding or the like to form a unitary closure vent or the members may simply be positioned adjacent to one another either close coupled or a distance apart, or may be fixed one to the other a distance apart by convention means. In this embodiment the perforations of adjacent closure members may be aligned with an offset from one another. Preferably, the perforations are offset to further aid in deterring penetration of water and the like. It is also desirable to attach an adhesive on portions of the bottom surface of at least one of the closure members to secure the ridge closure vent to the roof before installing the ridge panel. Preferably, an adhesive strip is connected to a bottom surface of an interior closure member for ease in installation of the ridge closure vent. The closure members may include weep holes along the bottom surface to allow condensation to drain.

In another preferred embodiment of the roof closure vent system, eave vent closures are fastened under the roof between the roof panels and the eave struts. The eave closure vent includes a first closure member having perforations formed laterally therethrough. The eave closure vent also includes a longitudinal filter slot extending substantially along its length and is of sufficient depth such that the perforations and filter slot are in communication forming a gas flow path. Disposed within the filter slot is a filter, which deters and prevents the entry of water, debris and pests from entering the interior of the structure through the perforations. The eave closure vent may further include at least a second closure member spaced from the first and connected therewith by another mesh mat. The second closure member further includes lateral perforations therethrough, a filter slot, and filter. The eave closure members may also be aligned with or offset from the perforations of the adjacent closure member. Preferably, the perforations of adjacent closure members are offset to further block water and the like which may pass through the mesh mat. It is also desirable to have weep holes formed along the bottom surface of the exterior most closure member to allow any condensation to drain. In addition, the interior closure members may have weep holes formed along their bottom surface. It is further desirable to have an adhesive on a bottom surface of at least one of the closure members to aid in installation of the eave closure vent.

Preferably, the eave closure vent is used in conjunction with the ridge closure vent of the present invention to provide passive ventilation of the structure. However, the eave closure vent may be used alone or in conjunction with other types of roof ventilators.

In another embodiment of the ridge closure vent and the eave closure vent, the closure member(s) have at least one perforation formed laterally there through. The perforations define a gas flow path and a filter slot. Disposed within the filter slot is a filter, which deters the entry of water, debris and pests from entering the interior of the structure through the perforations.

In the most preferred embodiment, the roof closure vent system includes a ridge closure vent and eave closure vents. In this embodiment each of the closure vents includes at least one closure member and one mesh mat connected thereto. The closure vents may include additional closure members to provide further strength to the roof and to further deter penetration of water, debris and pests.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
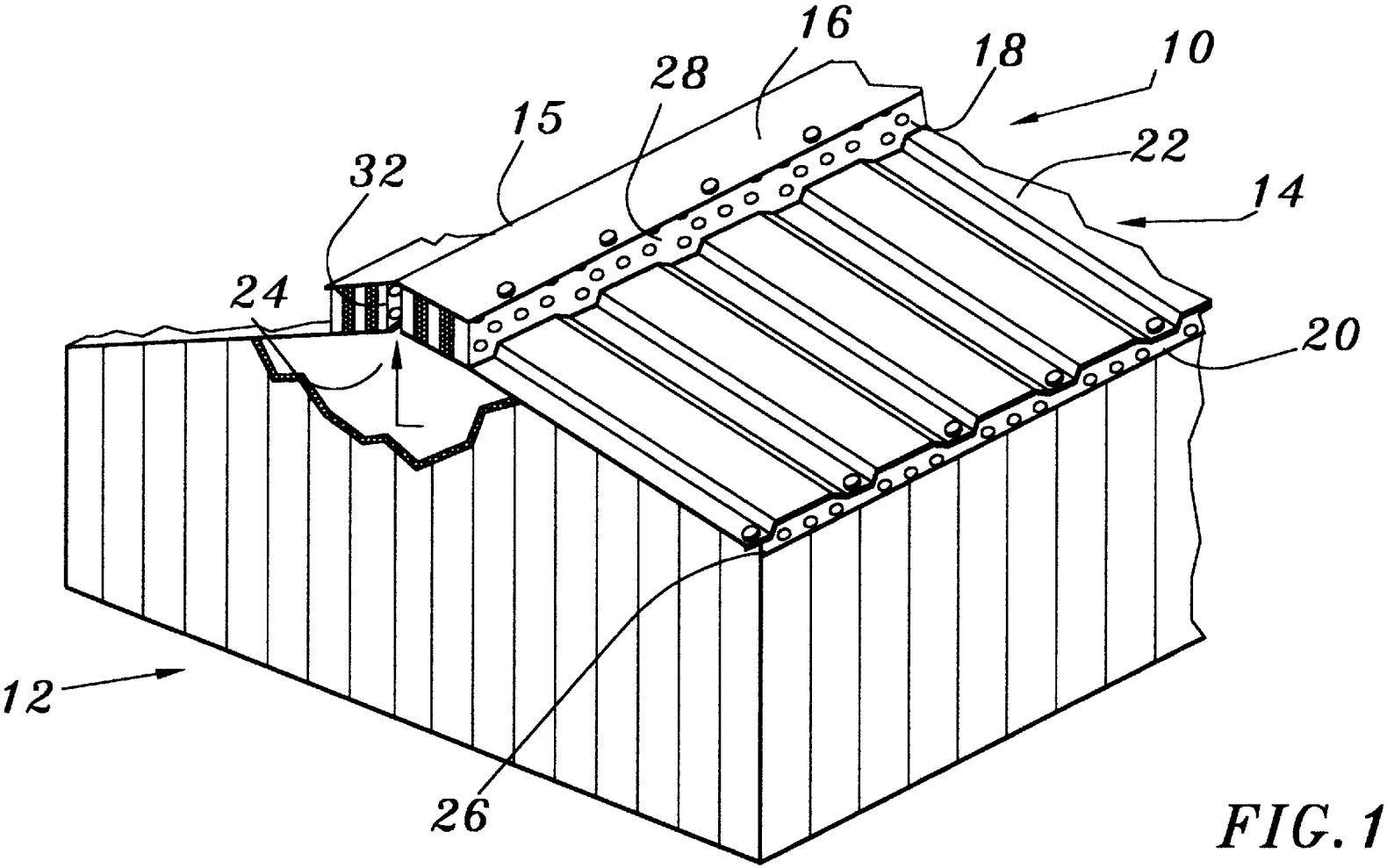
FIG. 1 is a sectional view of an embodiment of the roof closure vent system.

FIG. 1 is a partial, sectional perspective view of an exemplary embodiment of the roof closure vent system of the present invention generally designated by the numeral 10. Closure vent system 10 includes a structure 12 having a metal roof 14, a ridge panel 16, a ridge closure vent 18 and an eave closure vent 20.

Building 12 may be any type of structure having metal roof 14. Metal roof 14 is constructed of roof panels 22 fastened to the eave struts and purlins (not shown) in any manner well known in the art such as with screws. As shown in this embodiment, roof panels 22 are corrugated panels, however, this invention is equally applicable to other panel types such as standing seam panels. Roof panels 22 of the opposing sides of roof 14 terminate approximate at the ridge 15 of roof 14 to define an open ridge slot 24 along the length of the roofs ridge 15 permitting ventilation from the interior under roof 14.

Ridge closure vents 18 are positioned adjacent each longitudinal side of ridge slot 24 extending substantially along the length of slot 24 and fastened between ridge panel 16 and roof 14. Ridge panel 16 is connected atop ridge closure vents 18 and securely attached with screws to prevent rain and other debris from entering through ridge slot 24. In this manner air vents from under roof 14 through ridge closure vent 18 to the exterior as shown by the arrows.

Eave closure vents 20 are provided to aid in ventilation through ridge closure vents 18. Eave closure vents 20 are connected between the eave struts (not shown) and roof 14 along the horizontal eave 26 of roof 14. Eave closure vent 20 permits air to flow therethrough under roof 14 to aid in ventilation through ridge closure vent 18.

Figure 2:
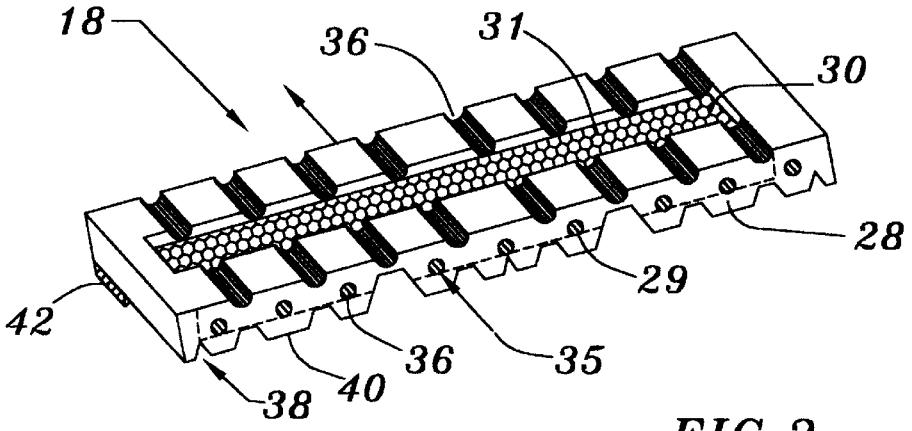
FIG. 2 is a sectional view of the ridge closure vent.

FIG. 2 is a perspective view of a section of ridge closure vent 18. Ridge closure vent 18 is constructed of a first closure member 28 comprising a single unitary structure. It is not required that closure vent 18 be constructed as a unitary structure, in the alternative closure member 28 may be positioned adjacent to one or more additional closure members in a layered fashion. It can be further seen from FIG. 2, that closure vent 18 includes a longitudinal filter slot 30 for housing a filter 31 shown disposed therein.

Closure member 28 of this embodiment is constructed of a cross linked polyethylene material. However, closure member 28 may be constructed of any plastic, rubber, metal, wood, nylon, phenolic or other composite material. The durable characteristics of member 28 permits ridge panel 16 to be securely connected to roof 14 with out collapsing ridge closure vent 18 thereby preventing ventilation.

Formed along the length of each member 28 and laterally therethrough are perforations 36, which define a path to allow air/gas to flow therethrough. Perforations 36 are formed through each member 28 and may be offset from or aligned with perforations 36 of adjacent members. This manner of offsetting perforations 36 allows air to flow through closure vent 18, and in combination with filter 31 prevents water, such as, from wind driven rain to pass therethrough.

Filter 31 is disposed within the filter slots 30 of closure member 28. Filter slot 30 is of sufficient depth such that filter slot 30 is in communication with perforations 36 the outline of which is designated by lines 29. Filter 31 is disposed within filter slot 30 to substantially fill the space within filter slot 30. Thus, filter 30 is generally perpendicular to and defines a portion of the gas flow path 35 of each closure member 28 allowing air/gas to flow through perforations 36. In addition, filter 31 aids in preventing water, debris and pests from passing through ridge closure vent 18 to the interior of building 12.

Filter 31 may be made of a non-woven synthetic fiber such as nylon or polyester. The fibers are opened and blended, then randomly aligned into a web by airflow. The web is then treated with binding agents of a water based phenolic and latex. The treated web is then oven cured to bind the fibers into a relatively rigid mat having a significant porous area between the random fibers. In an alternative embodiment, filter 31 may be a metal or plastic screen material or any other suitable screening material, which may be inserted or disposed within a filter slot.

With reference to FIG. 1 and 2, ridge closure vent 18 includes a plurality of weep holes 38. Weep holes 38 extend upwardly from the bottom surface 40 of closure member 28, which is the exterior most closure member exposed to the exterior of structure 12. Weep holes 38 permit water which may condense within filter 31 to drain.

As further shown in FIG. 1 and 2, an adhesive strip 42 is connected to the bottom surface 40 of closure member 28, on the interior most portion of the closure member, and oriented towards the interior of structure 12. Adhesive strip 42 permits roof closure vent 18 to be placed on roof 14 and maintained in place until ridge panel 16 is connected.

Figure 3:
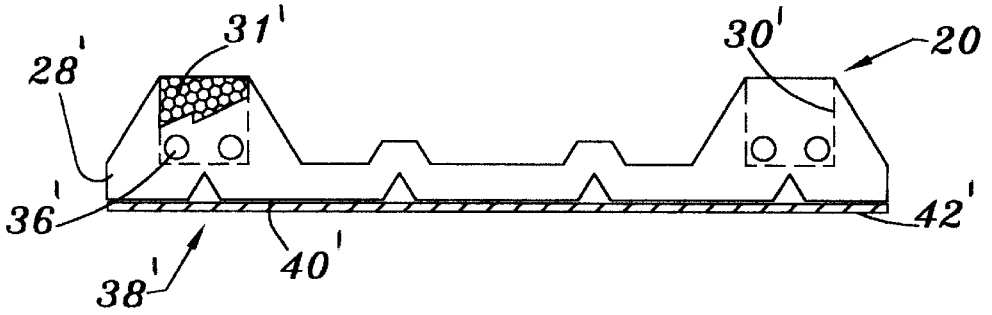
FIG. 3 is a sectional view of the eave closure vent.

FIG. 3 is a side view of eave closure vent 20. As shown the first closure member 28', has weep holes 38' formed along the bottom surface 40' thereof. The eave closure vent 20 is constructed in a similar fashion as the ridge closure vent 18, having a filter slot 30' and a filter 31' disposed therein. Eave closure vent 20 may also include an adhesive strip 42' on a bottom surface 40' thereof.

As shown in FIGS. 1 though 3, ridge closure vent 18 and eave closure vent 20 are constructed to have a profile to match the contour of roof panels 22. Due to the many different configurations of metal roof panels 22, closure vents 18 and 20 are constructed having various profiles and may be constructed to match individual applications.

Figure 4:
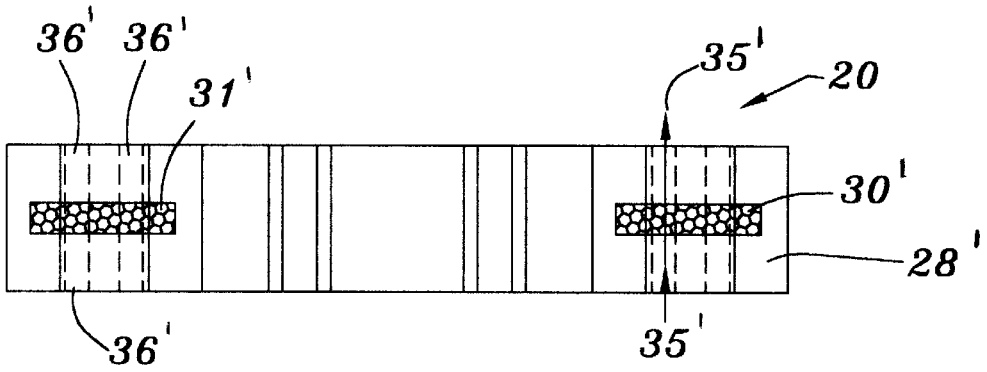
FIG. 4 is a plan view of the eave closure vent.

FIG. 4 is a top view of eave closure vent 20. Eave closure vent 20 is constructed in the same manner and from the same material as is ridge closure vent 18 (FIG. 2). The difference between closure vent 18 and closure vent 20 is that each has a profile to match the contour of the members between which each is connected.

As shown in FIG. 4, eave closure vent 20 is constructed of closure member 28'. The closure member 28' includes perforations 36' extending laterally therethrough. Preferably, perforations 36' are formed through closure members 28' such that perforations 36' are offset from the perforations on any adjacent closure members. It can be further seen from FIG. 4, that closure vent 20 includes a longitudinal filter slot 30' for housing a filter 31' shown disposed therein. Filter 31' is disposed within filter slot 30' to prevent water, debris and pests from penetrating past eave closure vent 20. Closure member 28' is constructed of the same materials as closure member 28 of ridge closure vent 18 to provide the strength and rigidity to eave closure vent 20 required for secure attachment to metal roof 14 without being crushed.

Figure 5:
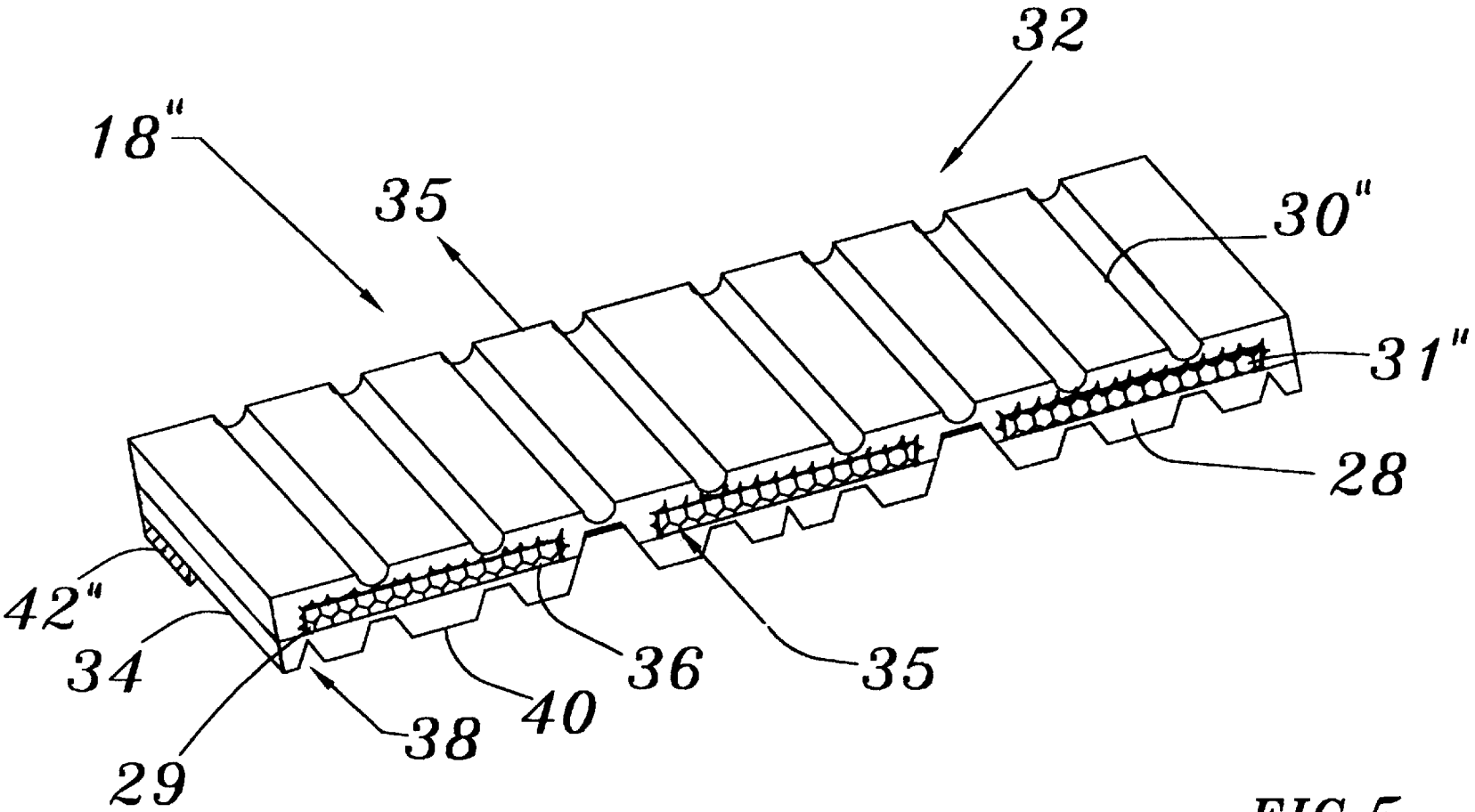
FIG. 5 is a plan view of the eave closure vent.

FIG. 5 shows an alternative embodiment for ridge closure vent 18 and eave closure vent 20. As shown in FIG. 5, eave closure vent 22 is constructed of closure is member 28". The closure member 28" further includes at least one perforation 36" extending laterally therethrough. Preferably, perforation 36" is formed through closure member 28' so that perforations 36" are offset from the perforations on any adjacent closure member included in the system. It can be further seen from FIG. 5, that disposed within the perforation 36" of closure vent 22 is a filter 31". Filter 31" is disposed within perforation 36" to prevent water, debris and pests from penetrating past eave closure vent 20. Closure member 28" is constructed of the same materials as closure member 28 of ridge closure vent 18.

Use of roof closure vent system 10 of the present invention is now described with reference to FIGS. 1–5. In constructing a building 12 which is to have a metal roof 14 a strip of eave closure vent 20 is attached along the length of each eave strut (not shown), then rows of roof panels 22 are connected to the structure to form metal roof 14 leaving a ridge slot 24 along the roof ridge 15 to allow air to escape from beneath roof 14. Ridge closure vents 18 are then connected atop roof panels 22, adjacent ridge slot 24, with adhesive strips 42 or the like. A ridge panel 16 is then fastened to roof 14 atop ridge closure vents 18. With roof closure vent system 10 installed air is vented from interior under roof 14 through perforations 36 formed in closure vent 18 by convection and/or wind suction. Stale vented air is replaced by ambient air provided through eave closure vent 20.

The offset alignment of perforations 36 and 36' and 36" of closure vents 18, 20 and 22 aid in preventing water and debris from passing through closure vents 18, 20, and 22 and entering the interior of building 12. Filters 31, 31' and 31" further prevent water penetration, deters pest from entering through perforations 36, 36' and 36".

It can be seen from the preceding description that a device for providing ventilation from beneath a metal roof which has a ridge closure vent and an eave closure vent, has layered closure vents which provide ventilation without permitting the penetration of water, debris and pest therethrough, that permits ventilation without compromising the secure installation of the roof panels and the ridge panel, and that does not require any additional labor, equipment or accessories from conventional metal roof installations has been provided.

It is noted that the embodiment of the roof closure vent system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A roof closure vent system comprising:

a structure having a sloped metal roof having a ridge slot formed along the length of a roof ridge permitting gas to vent from the interior of said structure to the exterior;

a ridge closure vent positioned adjacent each longitudinal side of said ridge slot extending along the length thereof positioned between a roof covering and a ridge cap;

said ridge closure vent comprising:

a closure member having at least one perforation formed laterally therethrough and extending through said closure member forming a gas flow path; and a filter disposed within said gas flow path to prevent material from entering the structure from the exterior thereof.

2. A roof closure vent system comprising:

a structure having a sloped metal roof having a ridge slot formed along the length of a roof ridge permitting gas to vent from the interior of said structure to the exterior;

a ridge closure vent positioned adjacent each longitudinal side of said ridge slot extending along the length thereof positioned between a roof covering and a ridge cap;

said ridge closure vent comprising:

a plurality of closure members having perforations formed laterally therethrough and extending through said closure member forming a gas flow path; and a filter disposed within said gas flow path to prevent material from entering the structure from the exterior thereof.

3. The roof closure vent system of claim 1, wherein:

said closure member forms weep holes extending upwardly from a bottom surface thereof.

4. The roof closure vent system of claim 2, wherein:

at least said closure member most exterior forms weep holes extending upwardly from a bottom surface thereof.

5. The roof closure vent system of claim 1, further comprising:

an eave closure vent disposed beneath said roof covering along the length of an eave of said roof;

said eave closure vent comprising:

a closure member having at least one perforation extending through said closure member forming a gas flow path; and a filter disposed within said gas flow path to prevent material from entering the structure from the exterior thereof.

6. The roof closure vent system of claim 1, further comprising:

an eave closure vent disposed beneath said roof covering along the length of an eave of said roof;

said eave closure vent comprising:

a plurality of closure members having at least one perforation extending through said closure member forming a gas flow path; and a filter disposed within said gas flow path to prevent material from entering the structure from the exterior.

7. The roof closure vent system of claim 2, further comprising:

an eave closure vent disposed beneath said roof covering along the length of an eave of said roof;

said eave closure vent comprising:

a closure member having at least one perforation extending through said closure member forming a gas flow path; and a filter disposed within said gas flow path to prevent material from entering the structure from the exterior thereof.

8. The roof closure vent system of claim 2, further comprising:

an eave closure vent disposed beneath said roof substantially along the length of an eave of said roof;

said eave closure vent comprising:

a plurality of closure members having at least one perforation extending through said closure member forming a gas flow path; and a filter disposed within said gas flow path to prevent material from entering the structure from the exterior.

9. The roof closure vent system of claim 5, wherein said ridge closure member and said eave closure member forms weep holes extending upwardly from a bottom surface thereof.

10. The roof closure vent system of claim 6, wherein said ridge closure member and said eave closure member forms weep holes extending upwardly from a bottom surface thereof.

11. The roof closure vent system of claim 7, whereinat least said ridge closure member and said eave closure member most exterior forms weep holes extending upwardly from a bottom surface thereof.

12. The roof closure vent system of claim 8, whereinat least said ridge closure member and said eave closure member most exterior forms weep holes extending upwardly from a bottom surface thereof.

13. A roof closure vent system comprising:

a structure having a sloped metal roof having a ridge slot formed along the length of a roof ridge permitting gas to vent from the interior of said structure to the exterior;

a ridge closure vent positioned adjacent each longitudinal side of said ridge slot extending along the length thereof fixed between said roof and a ridge panel;

said ridge closure vent comprising:

a closure member having perforations formed laterally therethrough defining a gas flow path, and a filter disposed within said perforations to prevent material from entering the structure from the exterior thereof.

14. A roof closure vent system comprising:

a structure having a sloped metal roof having a ridge slot formed along the length of a roof ridge permitting gas to vent from the interior of said structure to the exterior;

a ridge closure vent positioned adjacent each longitudinal side of said ridge slot extending along the length thereof fixed between said roof and a ridge panel;

said ridge closure vent comprising:

a plurality of closure members having perforations formed laterally therethrough defining a gas flow path, and a filter disposed within said perforations to prevent material from entering the structure from the exterior thereof.

15. The roof closure vent system of claim 13, wherein:

said closure member forms weep holes extending upwardly from a bottom surface thereof.

16. The roof closure vent system of claim 14, wherein:

at least said closure member facing exterior forms weep holes extending upwardly from a bottom surface thereof.

17. The roof closure vent system of claim 13, further comprising:

an eave closure vent disposed beneath said roof substantially along the length of an eave of said roof;

said eave closure vent comprising:

a closure member having perforations formed laterally therethrough defining a gas flow path, and a filter disposed within said perforations to prevent material from entering the structure from the exterior thereof.

18. The roof closure vent system of claim 13, further comprising:

an eave closure vent disposed beneath said roof substantially along the length of an eave of said roof;

said eave closure vent comprising:

a plurality of closure members, having perforations formed laterally therethrough defining a gas flow path, and a filter disposed within said perforations to prevent material from entering the structure from the exterior thereof.

19. The roof closure vent system of claim 14, further comprising:

an eave closure vent disposed beneath said roof substantially along the length of an eave of said roof;

said eave closure vent comprising:

a closure member having perforations formed laterally therethrough defining a gas flow path, and a filter disposed within said perforations to prevent material from entering the structure from the exterior thereof.

20. The roof closure vent system of claim 14, further comprising:

an eave closure vent disposed beneath said roof substantially along the length of an eave of said roof;

said eave closure vent comprising:

a plurality of closure members, having perforations formed laterally therethrough defining a gas flow path, and a filter disposed within said perforations to prevent material from entering the structure from the exterior thereof.

21. The roof closure vent system of claim 17, wherein said ridge closure member and said eave closure member forms weep holes extending upwardly from a bottom surface thereof.

22. The roof closure vent system of claim 18, wherein said ridge closure member and said eave closure member forms weep holes extending upwardly from a bottom surface thereof.

23. The roof closure vent system of claim 19, wherein at least said ridge closure member and said eave closure member most exterior forms weep holes extending upwardly from a bottom surface thereof.

24. The roof closure vent system of claim 20, wherein at least said ridge closure member and said eave closure member most exterior forms weep holes extending upwardly from a bottom surface thereof.

25. The roof closure vent system of claim 5, further including:

an adhesive on a bottom surface of at least one said ridge closure member and said eave closure member.

26. The roof closure vent system of claim 6, further including:

an adhesive on a bottom surface of at least one said ridge closure member and said eave closure member.

27. The roof closure vent system of claim 7, further including:

an adhesive on a bottom surface of at least one said closure member of said ridge closure vent.

28. The roof closure vent system of claim 8, further including:

an adhesive on a bottom surface of at least one said closure member of said ridge closure vent.

29. A roof closure vent comprising:

a closure member having at least one perforation extending laterally therethrough forming a gas flow path, and a longitudinal filter slot extending along the length of said closure member such that said slot is in communication with said gas flow path; and a filter disposed within said gas flow path to prevent material from passing through the gas flow path.

30. The roof closure vent of claim 29, wherein:

said closure member forms weep holes extending upwardly from a bottom surface thereof.

31. The roof closure vent system of claim 29, further including:

an adhesive on a bottom surface of at least one said closure member of said ridge closure vent.

32. A roof closure vent comprising:

a closure member having perforations formed laterally therethrough defining a gas flow path, and a filter disposed within said perforations to prevent material from entering the structure from the exterior thereof.

33. The roof closure vent of claim 32, wherein:

said closure member forms weep holes extending upwardly from a bottom surface thereof.

34. The roof closure vent system of claim 32, further including:

an adhesive on a bottom surface of at least one said closure member of said ridge closure vent.

35. A roof closure vent comprising;

a closure member, a filter adjacent said closure member, wherein said closure member and said filter are disposed between a ridge cap and a roof covering.

36. The roof closure vent of claim 35, wherein:

said closure member forms weep holes extending upwardly from a bottom surface thereof.

37. A roof closure vent comprising:

a closure member, having at least one perforation extending therethrough, wherein said closure member is disposed between a ridge cap and a roof covering.

38. A roof closure vent comprising:

a closure member, having at least one perforation extending therethrough, wherein said closure member is disposed between a ridge cap and a roof covering.

39. The roof closure vent of claim 38, wherein said closure member forms weep holes extending upwardly from a bottom surface thereof.

40. The roof closure vent of claim 38, further comprising:

an adhesive on a bottom surface of said closure member.

* * * * *